US005878720A

United States Patent [19]

Anderson et al.

[11] Patent Number: 5,878,720

[45] Date of Patent: Mar. 9, 1999

[54] HYDRAULICALLY ACTUATED FUEL INJECTOR WITH PROPORTIONAL CONTROL

[75] Inventors: Michael D. Anderson, Metamora; Shikui K. Chen, Peoria; Mark F. Sommars, Sparland, all of Ill.

[73] Assignee: Caterpillar Inc., Peoria, Ill.

[21] Appl. No.: 806,975

[22] Filed: Feb. 26, 1997

[51] Int. Cl.[6] ..... F02M 37/04

[52] U.S. Cl. ..... 123/496; 123/446

[58] Field of Search ..... 123/496, 446, 123/447, 500, 501, 458; 239/88–96, 585.1

[56] References Cited

U.S. PATENT DOCUMENTS

| | | | |
|---|---|---|---|
| 4,722,364 | 2/1988 | Kubach et al. | 137/625.65 |
| 4,905,961 | 3/1990 | Ichihashi et al. | 251/129.15 |
| 4,979,674 | 12/1990 | Taira et al. | 239/90 |
| 5,108,070 | 4/1992 | Tominaga | 251/65 |
| 5,143,291 | 9/1992 | Grinsteiner | 239/88 |
| 5,309,944 | 5/1994 | Chikamatsu et al. | 137/625.65 |
| 5,445,129 | 8/1995 | Barnes | 123/496 |
| 5,460,329 | 10/1995 | Sturman | 239/96 |
| 5,463,996 | 11/1995 | Maley et al. | 123/446 |
| 5,651,345 | 7/1997 | Miller | 123/496 |
| 5,655,501 | 8/1997 | Hafner | 123/496 |
| 5,664,545 | 9/1997 | Kato | 123/496 |
| 5,694,903 | 12/1997 | Ganser | 123/496 |
| 5,738,075 | 4/1998 | Chen | 123/496 |

*Primary Examiner*—Carl S. Miller
*Attorney, Agent, or Firm*—Michael McNeil

[57] ABSTRACT

A hydraulically actuated fuel injector includes an injector body having a nozzle chamber that opens to a nozzle outlet. A control valve is mounted in the injector body and is attached to a solenoid that is moveable between a rest position and a fully energized position. A piston/plunger/barrel assembly is utilized to hydraulically pressurize fuel in the nozzle chamber to a fuel pressure that is substantially proportional to an amount of current being supplied to the solenoid. A needle valve member is positioned in the nozzle chamber and moveable between an open position in which the nozzle outlet is opened and a closed position in which the nozzle outlet is blocked. Finally, a spring is utilized to bias the solenoid toward its rest position.

20 Claims, 6 Drawing Sheets

SQUARE

RAMP

BOOT

PILOT

HYDRAULICALLY ACTUATED FUEL INJECTOR WITH PROPORTIONAL CONTROL

TECHNICAL FIELD

The present invention relates generally to hydraulically actuated fuel injectors, and more particularly to a hydraulically actuated fuel injection system that injects fuel in proportion to the amount of current received by a solenoid actuated control valve.

BACKGROUND ART

Engineers have long known that combustion efficiency, exhaust emissions and noise in a diesel type internal combustion engine can be improved by controlling the injection rate of fuel to the combustion chamber. Over the years, engineers have identified at least four different injection rate shapes that decrease undesirable emissions and noise from an engine, depending upon the engine's particular operating conditions. These four different injection rate shapes are generally known in the art as a square, ramp, boot and pilot injection rate shapes. These different injection rate shapes generally refer to the front end portion of the injection rate profile. In almost all cases it is desirable that the injection rate provide a nearly vertical abrupt end to each injection event. While there are many fuel injectors that have the ability to provide at least one of the desired injection rate shapes, engineers have encountered substantial difficulty in providing a single fuel injector or fuel injection system that can provide each of the different injection rate shapes on command during a given operating condition for an engine. In other words, the ability to control the injection rate at each point during an injection event has proved very problematic to achieve.

The present invention is directed to overcoming one or more of the problems as set forth above.

DISCLOSURE OF THE INVENTION

According to one embodiment of the present invention, a hydraulically actuated fuel injector includes an injector body having a nozzle chamber that opens to a nozzle outlet. A control valve is mounted in the injector body and attached to a solenoid that is moveable between a rest position and a fully energized position. A hydraulic means, within the injector body, pressurizes fuel in the nozzle chamber to a fuel pressure that is substantially proportional to an amount of current being supplied to the solenoid. A needle valve member, which is positioned in the nozzle chamber, is moveable between an open position in which the nozzle outlet is open and a closed position in which the nozzle outlet is blocked. Some means, such as a spring, is provided for biasing the solenoid toward its rest position.

When in operation, the fuel injection rate is substantially proportional to the amount of current supplied to the solenoid. This is accomplished by the use of a special solenoid actuated control valve that supplies high pressure actuation fluid to the hydraulic pressurizing means in proportion to the amount of current supplied to the solenoid. The result being that the actuation fluid pressure seen by the hydraulic pressurizing means is proportional to the displacement position of the solenoid actuated control valve. This in turn results in the fuel pressure being substantially proportional to the actuation fluid pressure. Finally, the injection rate is substantially proportional to the fuel pressure. The end result being an injection rate that is substantially proportional to the amount of current supplied to the solenoid, thus permitting the injection rate to be minutely controlled throughout an injection event by close control of current supplied to the solenoid actuated control valve.

One object of the present invention is to provide a hydraulically actuated fuel injector in which the injection rate is proportional to current supplied to the solenoid actuated control valve.

Another object of the present invention is to improve control over the injection rate from a hydraulically actuated fuel injector independent of other variables.

Still another object of the present invention is to improve control over the performance of hydraulically actuated fuel injectors.

Another object of the present invention is to improve combustion efficiency while decreasing undesirable emissions and noise from a diesel type internal combustion engine.

BEST MODE FOR CARRYING OUT THE INVENTION

Figure 1:
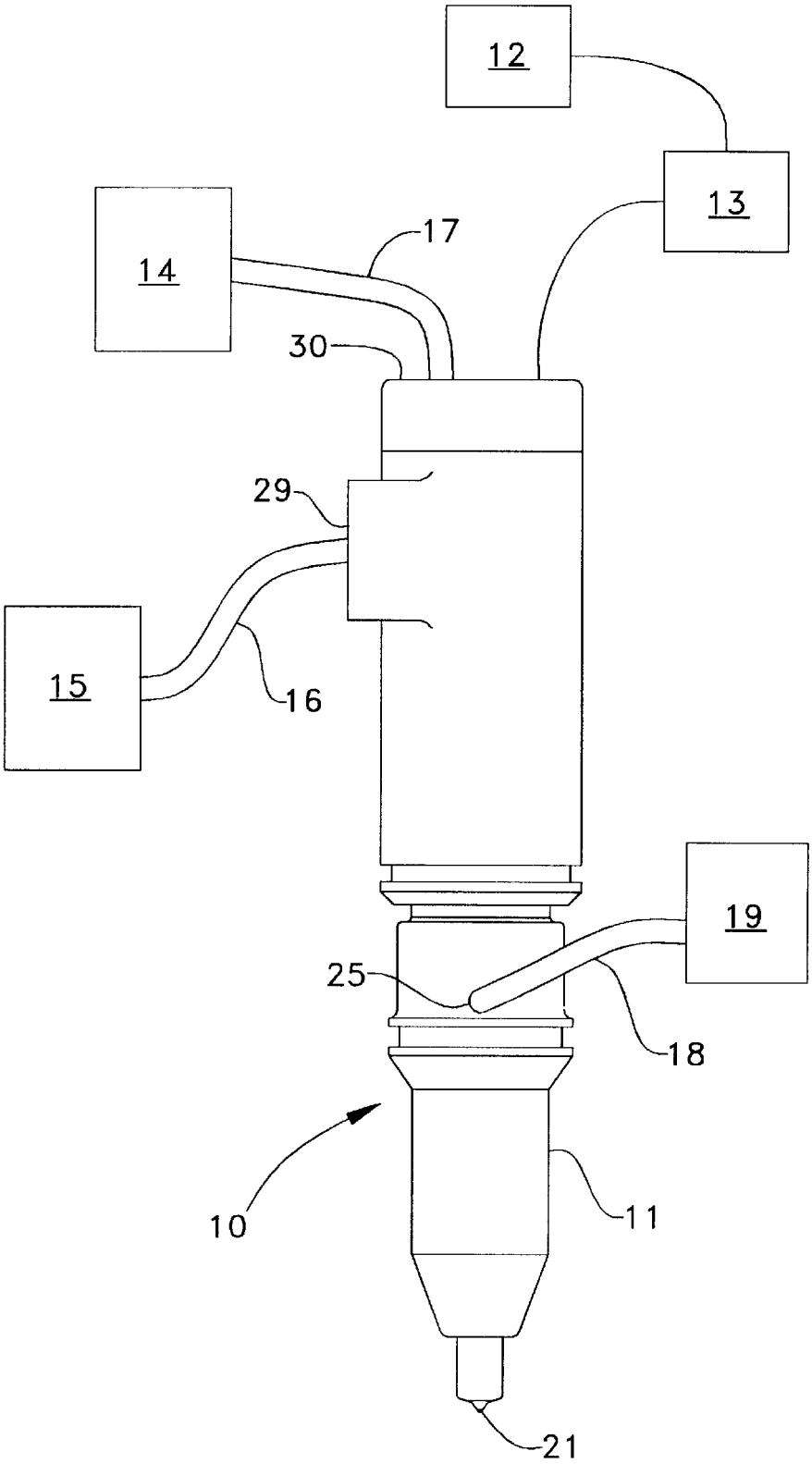
FIG. 1 is a schematic illustration of a hydraulically actuated fuel injection system according to the present invention.

Referring now to FIG. 1, a hydraulically actuated fuel injection system 10 includes a hydraulically actuated fuel injector 11 having a fuel supply passage 25, an actuation fluid inlet 30, an actuation fluid drain 29 and a nozzle outlet 21. A first supply passage 17 connects actuation fluid inlet 30 to a source of high pressure actuation fluid 14, which is preferably a common rail at a substantially fixed pressure. A second supply passage 18 connects fuel supply passage 25 to a source of fuel fluid 19, which is different from the actuation fluid. A drain passage 16 connects actuation fluid drain 29 to a low pressure actuation fluid reservoir 15. A computer 12 is in communication with and capable of controlling a solenoid within fuel injector 11 via a current generating means 13.

Figure 1A:
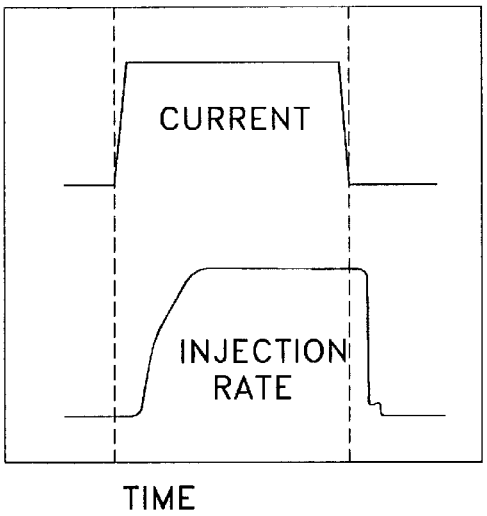
FIGS. 1A–D are graphs of solenoid current and injection rate for a square, ramp, boot and pilot injection rate profiles, respectively.
Figure 1B:
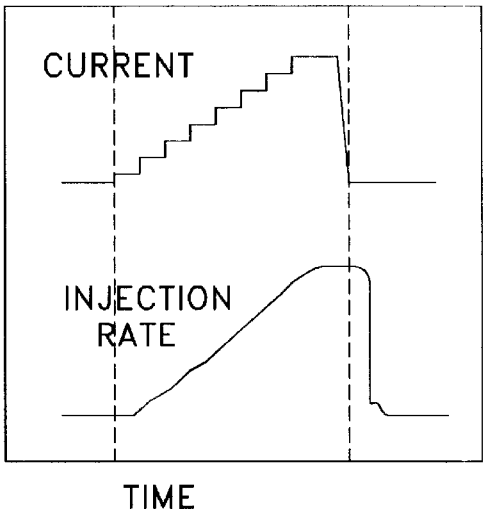
Figure 1C:
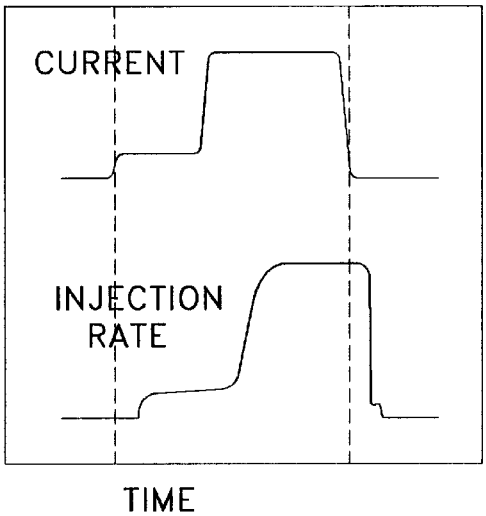
Figure 1D:
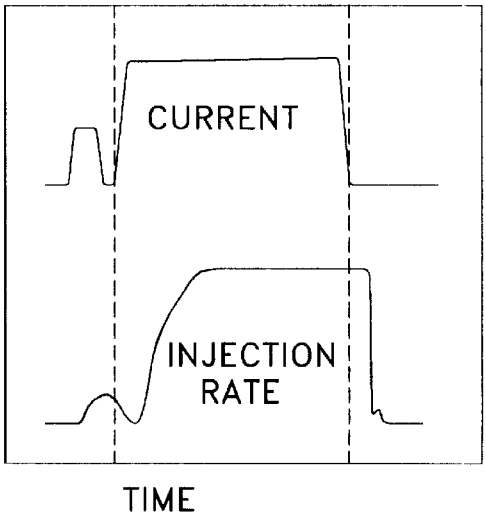

FIGS. 1A–D show various injection rate profiles that can be produced by the hydraulically actuated fuel injection system 10 shown in FIG. 1. In particular, FIG. 1A shows a square injection rate profile produced by supplying a substantially square current wave to the solenoid actuated control valve within fuel injector 11. FIG. 1B shows a ramp injection rate profile produced by supplying a steadily increasing amount of current to fuel injector 11. FIG. 1C shows that fuel injector 11 can produce a boot shaped injection rate profile by providing a generally boot shaped current wave to fuel injector 11. Finally, a split or pilot injection rate profile is shown in FIG. 1D by providing a split current wave to fuel injector 11. As can be seen, the injection rate for each of the different injection rate profiles is substantially proportional to the current wave shape supplied to the solenoid actuated control valve of fuel injector 11.

Figure 2:
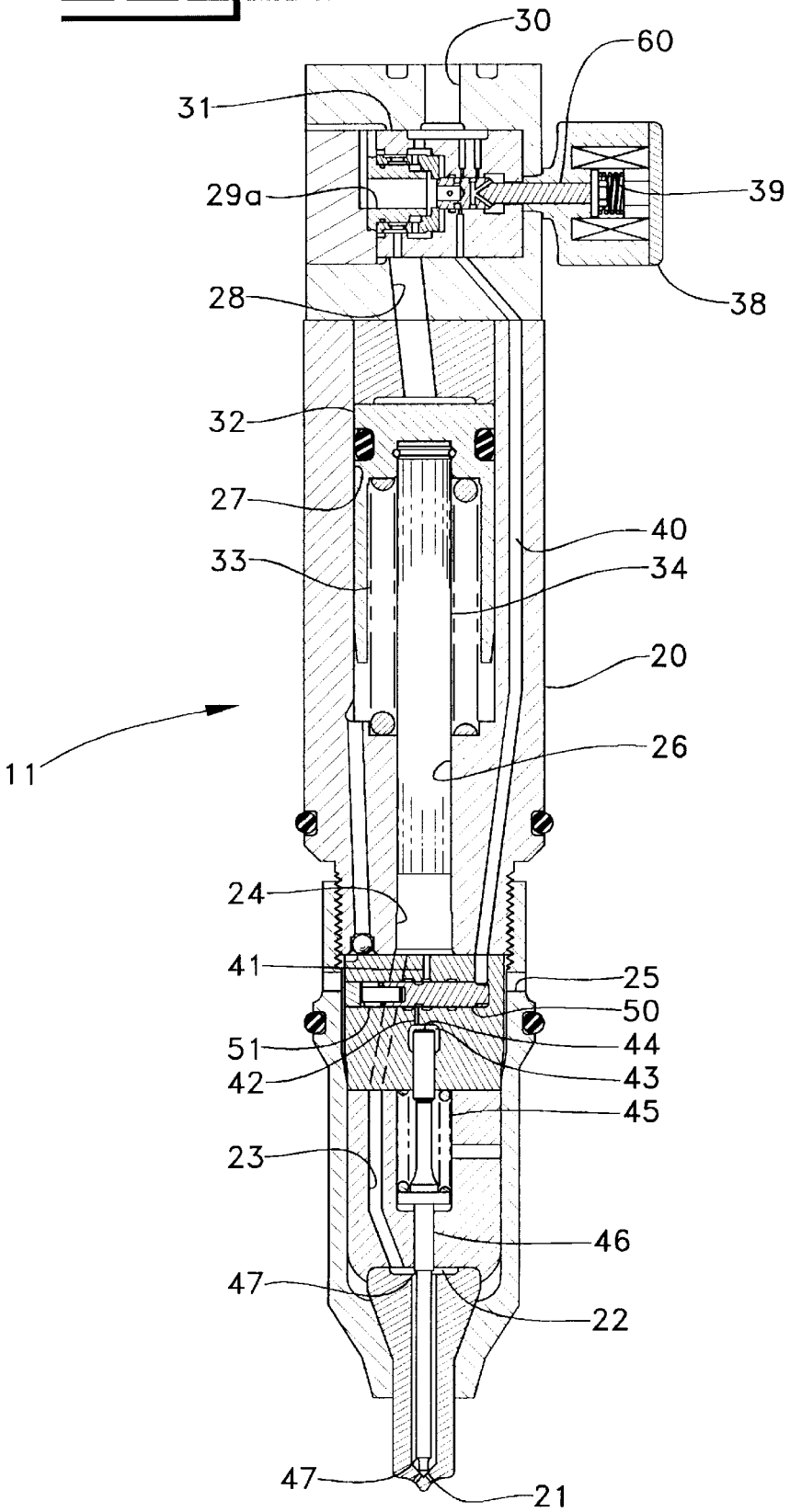
FIG. 2 is a sectioned side elevational view of a hydraulically actuated fuel injector according to one embodiment of the present invention.

Referring now to FIG. 2, hydraulically actuated fuel injector 11 works substantially similar and includes many of the same components utilized by other hydraulically actuated fuel injectors of the type manufactured by Caterpillar, Inc. of Peoria, Ill. Injector 11 includes an injector body 20 made up of various components attached to one another and machined to include various passageways in a manner well known in the art. In particular, injector body 20 includes an actuation fluid cavity 28 that opens to a piston bore 27, a high pressure actuation fluid inlet 30 and a low pressure actuation fluid drain 29*a*. A control valve 31 is mounted in injector body 20 and movably attached to a solenoid 38. Solenoid 38 is moveable between a rest position and a fully energized position, but is biased toward its rest position by a compression spring 39.

An intensifier piston 32 is mounted in piston bore 27 and moveable between an upper position, as shown, and a lower position. A plunger 34 is mounted in a piston bore 26 and is moveable between a retracted position, as shown, and an advanced position. A return spring 33 normally biases plunger 34 and piston 32 to their respective retracted and upper positions. A portion of plunger 34 and plunger bore 26 define a fuel pressurization chamber 24 which is supplied with fuel from fuel supply passage 25 via a passageway not shown. Normally, a check valve is included in this hidden passageway to prevent the back flow of fuel from fuel pressurization chamber 24 into fuel supply passage 25. Fuel pressurization chamber 24 is in fluid communication with a nozzle chamber 22 via a nozzle supply passage 23. Nozzle chamber 22 opens to nozzle outlet 21.

A needle valve member 46 is positioned in nozzle chamber 22 and moveable between a closed position in which nozzle outlet 21 is blocked and an open position in which nozzle outlet 21 is open to nozzle chamber 22. Needle valve member 46 includes lifting surfaces 47 which cause it to move to its open position against the action of compression biasing spring 45 when fuel pressure within nozzle chamber 22 is above a valve opening pressure. Needle valve member 46 also includes a control hydraulic surface 44 that is exposed to fluid pressure in needle control chamber 43, which is positioned in opposition to lifting hydraulic surfaces 47.

A shuttle valve member 50 is positioned in injector body 20 and moveable between a go position and a stop position depending upon whether control passage 40 is exposed to high pressure actuation fluid inlet 30 or low pressure actuation fluid drain 29*a*, which depends upon the position of control valve 31. Shuttle valve 50 is normally biased toward its stop position by a shuttle return spring 51. When shuttle valve 50 is in its stop position, needle control passage 42 is open to fuel pressurization chamber 24 via a connection passage 41. When the shuttle valve 50 is moved to the left against the action of return spring 51 to its go position, needle control passage 42 is open to a low pressure fuel return passage which is not shown.

Generally, hydraulically actuated fuel injector 11 operates in a manner similar to many other hydraulically actuated fuel injectors manufactured by Caterpillar, Inc. In particular, each injection event is initiated by energizing solenoid 38 to move control valve 31 to a position that opens high pressure actuation fluid inlet 30 to actuation fluid cavity 28. As high pressure actuation fluid flows into actuation fluid cavity 28, intensifier piston 32 and plunger 34 begin their downward movement. This downward movement compresses fuel in fuel pressurization chamber 24, which eventually reaches a valve opening pressure sufficient to lift needle valve member 46 to open nozzle outlet 21. Each injection event is ended when current to solenoid 38 is ended. This action causes shuttle valve 50 to move toward its stop position, and the residual high fuel pressure in fuel pressurization chamber 24 acts on the control hydraulic surface 44 of needle valve member 46 causing it to abruptly close to end the injection event.

Hydraulically actuated fuel injector 11 differs from previous hydraulically actuated fuel injectors in that control valve 31 can be positioned in a partially open position between its fully closed position and its fully open position so that actuation fluid pressure in actuation fluid cavity 28 is less than the rail pressure supplying actuation fluid to high pressure actuation fluid inlet 30. This ability of the present invention to proportionally control the position of control valve 31 allows the fuel injection rate to be in substantial proportional to the position of control valve 31.

Figure 3:
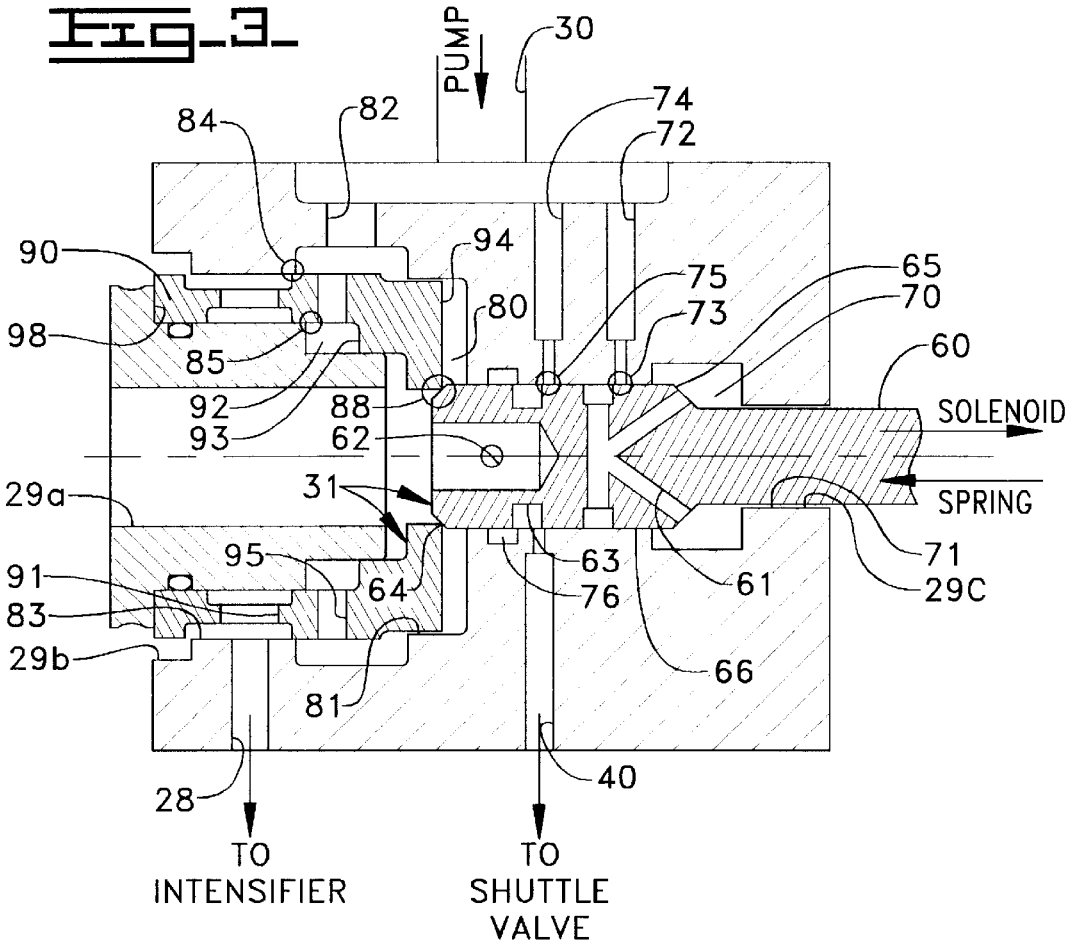
FIG. 3 is a partial sectioned side elevational view of a control valve according to one aspect of the present invention.

Referring now to FIG. 3, control valve 31 includes a pilot valve member 60 and an actuation valve member 90, both of which are spool valve members. Pilot valve member 60 has one end attached to the armature of solenoid 38 (FIG. 2). Solenoid return spring 39 biases pilot valve member 60 toward a first position, as shown, but the pilot valve member is moveable toward the right to a second position when the solenoid is fully energized. Injector body 20 and a portion of pilot valve member 60 define a pilot balance chamber 70. Pilot balance chamber 70 is open to a third actuation fluid drain 29*c* through a restricted drain passage 71. Pilot balance chamber 70 is also opened through an pilot balance passage 61 to its outer surface 66. In the position shown, pilot balance chamber 70 is isolated from high pressure actuation fluid inlet 30; however, when pilot valve member 60 moves to the right, variable flow area seat 73 connects a branch passage 72 to the pilot balance passage 61 into pilot balance chamber 70. As current is supplied to the solenoid, pilot valve member 60 moves to the right opening variable flow area seat 73, whose flow area depends upon the position of pilot valve member 60. Thus, because restricted drain passage 71 has a relatively small known flow area, the fluid pressure within pilot balance chamber 70 can be regulated by controlling the position of pilot valve member 60 and hence the flow area through variable flow area seat 73. Pilot valve member 60 achieves an equilibrium position by the balance of the solenoid return spring force combined with the hydraulic force acting on pilot hydraulic surface 65 against the force supplied by the solenoid. Thus, the flow area through variable flow area seat 73 is substantially proportional to the amount of current being supplied to the solenoid.

When pilot valve member 60 is in the position shown, control passage 40 to shuttle valve 50 is open to low pressure drain passage 29*a* through annulus 63, annulus 76 and port 62. When pilot valve member 60 moves to the right, control seat 75 opens to allow high pressure actuation fluid to flow through branch passage 74 through annulus 63 and into control passage 40, causing shuttle valve member 50 to move to its go position. Annulus 63 closes to annulus 76 simultaneously with the opening of control seat 75 when pilot valve member 60 moves to the right. When the solenoid 38 is de-energized, its return spring 39 (FIG. 2) pushes pilot valve member 60 into contact with actuation valve member 90 at annular seat 88. Closure of annular seat 88 raises pressure in actuation balance chamber 80. The spring force combined with the hydraulic forces on pilot hydraulic surface 65 and closing hydraulic surface 94 push actuation valve member 90 to its back stop 98. This results in control seat 75, variable flow area seat 73 and annular seat 88 being closed.

Actuation valve member 90 includes an opening hydraulic surface 93 positioned in opposition to a closing hydraulic surface 94. In this embodiment, opening hydraulic surface 93 is constantly exposed to high pressure of actuation fluid inlet 30 via branch passage 82, internal passage 95 and chamber 92. Closing hydraulic surface 94 is exposed to fluid pressure in an actuation balance chamber 80 which is open to the high pressure of actuation fluid inlet 30 via branch passage 82 and an annular restricted supply passage 81, which has a known but small flow area. When pilot valve member 60 moves to the right under the action of the solenoid, annular seat 88 opens allowing pressure in actuation balance chamber 80 to drop because of flow past annular seat 88 into low pressure drain passage 29*a*. This drop in pressure within actuation balance chamber 80 causes actuation valve member 90 to move to the right until annular seat 88 is made sufficiently small that the opposing forces on opening hydraulic surface 93 and closing hydraulic surface 94 achieve a balance. Thus, actuation valve member 90 will follow the movement of pilot valve member 60 and will achieve a hydraulically balanced position in which actuation valve member 90 is just out of contact with pilot valve member 60.

In the solenoid rest position, actuation valve member 90 is in the position shown in which actuation fluid cavity 28 is open to a second low pressure actuation fluid drain 29*b* past an annular seat 83. As actuation valve member 90 moves to the right when the solenoid is energized, annular drain seat 83 closes simultaneously with the opening of low flow seat 84. When this occurs, high pressure actuation fluid can flow from inlet 30 through branch passage 82 past low flow seat 84 and into actuation fluid cavity 28 beginning the downward movement of intensifier piston 32 (FIG. 2). When higher current is supplied to the solenoid, actuation valve member 90 can move sufficiently far to the right that a high flow seat 85 opens to chamber 92 to allow even more actuation fluid to flow into actuation fluid cavity 28 through internal passage 91. Low flow seat and high flow seat 85 are sized and arranged such that the flow area past these seats is proportional to the position of actuation valve member 90. In other words, the flow area between actuation fluid inlet 30 and actuation fluid cavity 28 is directly related to the position of actuation valve member 90, which is directly related to the amount of current supplied to the solenoid. Hence, the pressure in actuation fluid cavity 28 is substantially proportional to the amount of current supplied to the solenoid. During low pressure demand conditions, only low flow seat 84 is opened, whereas during high demand conditions both low flow seat 84 and high flow seat 85 will be opened to provide adequate pressure at rated conditions.

Figure 4:
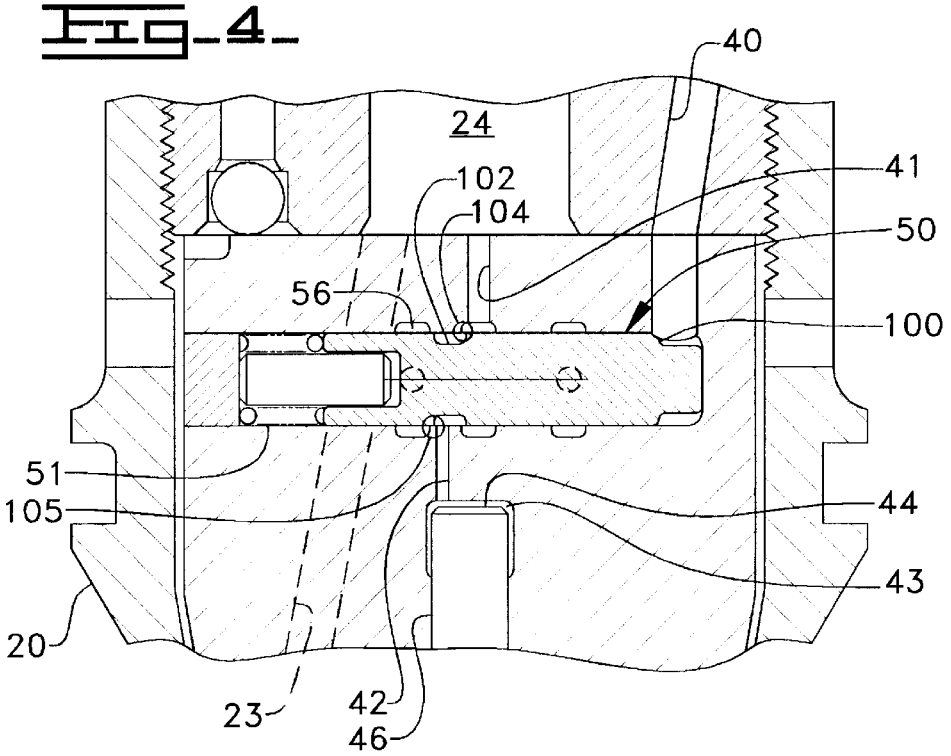
FIG. 4 is a partial sectioned side elevational view of a shuttle valve according to another aspect of the present invention.

Referring now to FIG. 4, the action of shuttle valve member 50 is better illustrated. Shuttle valve member 50 includes a shuttle hydraulic surface 100 exposed to fluid pressure in control passage 40. As discussed earlier, when the solenoid is de-energized, control passage 40 is opened to a low pressure drain such that shuttle return spring 51 pushes shuttle valve member 50 to its stop position as shown. When in this position, needle control chamber 43 is exposed to fuel pressure within fuel pressurization chamber 24 via connection passage 41 past seat 104 through annulus 102 and into control passage 42. When control passage 40 is open to the high pressure of actuation fluid inlet 30, shuttle valve member 50 moves to the left against the action of its return spring 51 until seat 105 opens substantially simultaneously with the closing of seat 104. This opens needle control chamber 43 to a low pressure fuel return passage (not shown) via control passage 42 and annulus 56. Shuttle valve member 50 is included in order to provide an abrupt end to each injection event since control chamber 40 is abruptly exposed to a low pressure drain passage upon the de-energization of the solenoid so that shuttle valve member 50 moves to the right toward the end of each injection event. This opens seat 104 so that the residual high pressure in fuel pressurization chamber 24 can act upon the control hydraulic surface 44 of needle valve member 46 causing it to abruptly close to end the injection event.

Figure 5:
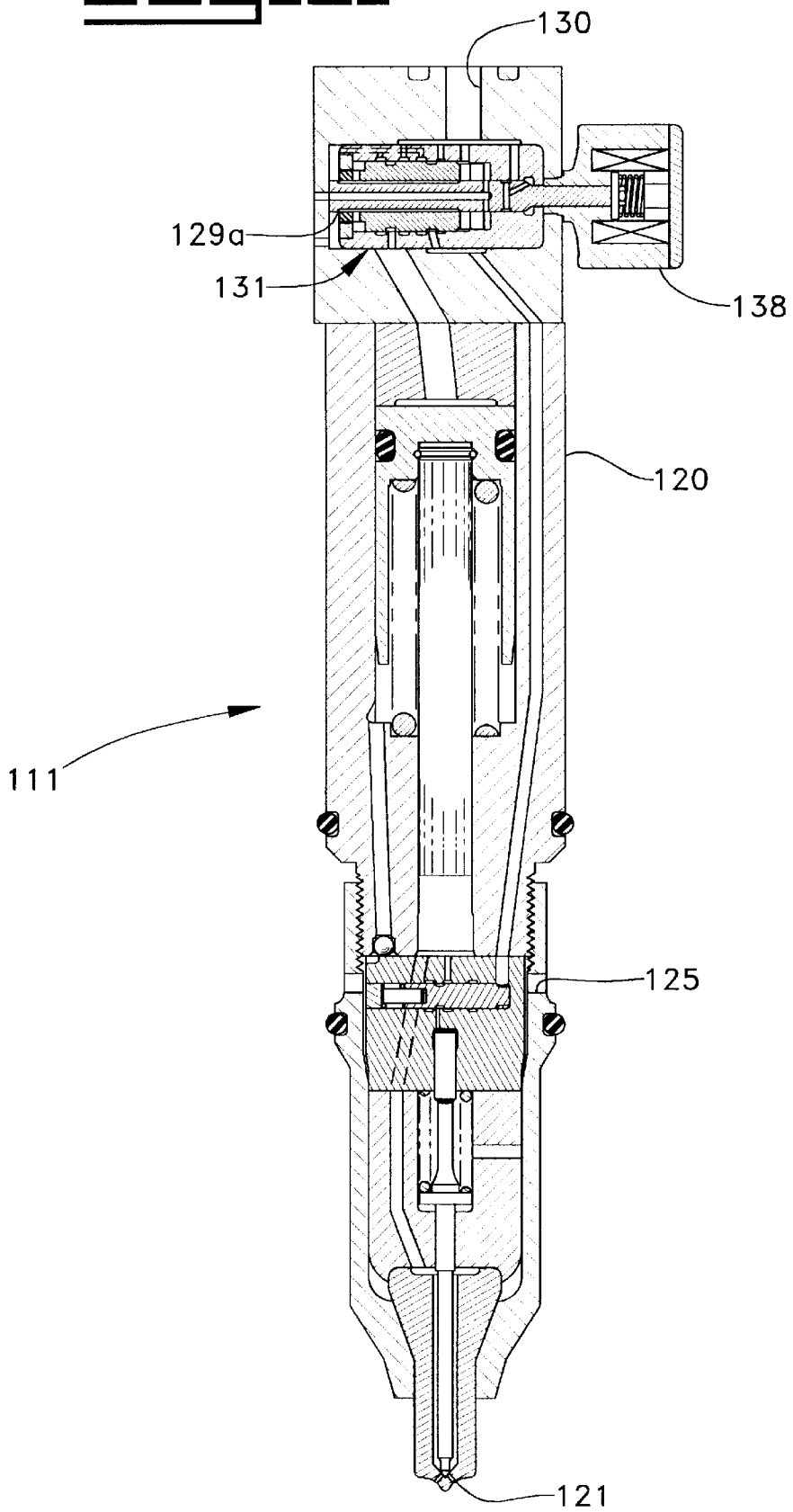
FIG. 5 is a sectioned side elevational view of a hydraulically actuated fuel injector according to another embodiment of the present invention.

Referring now to FIG. 5, a second embodiment of a hydraulically actuated fuel injector 111 is illustrated. This embodiment is substantially identical to the earlier embodiment except that the particular component structure and passageways surrounding its control valve 131 are different. Like the earlier embodiment, injector 111 includes an injector body 120 having a high pressure actuation fluid inlet 130, a fuel supply passage 125, a nozzle outlet 121 and a low pressure actuation fluid drain 129*a*. Like the previous embodiment, a solenoid 138 is attached to and controls the position of control valve 131.

Figure 6:
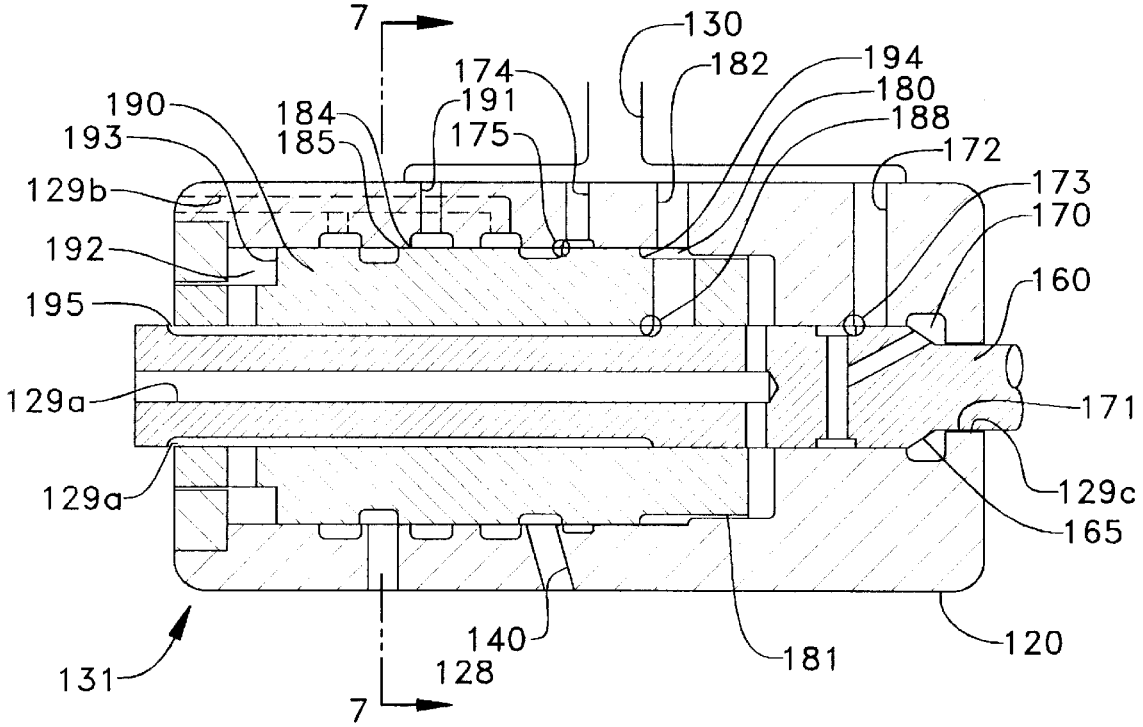
FIG. 6 is a partial sectioned side elevational view of a control valve according to another aspect of the present invention.
Figure 7:
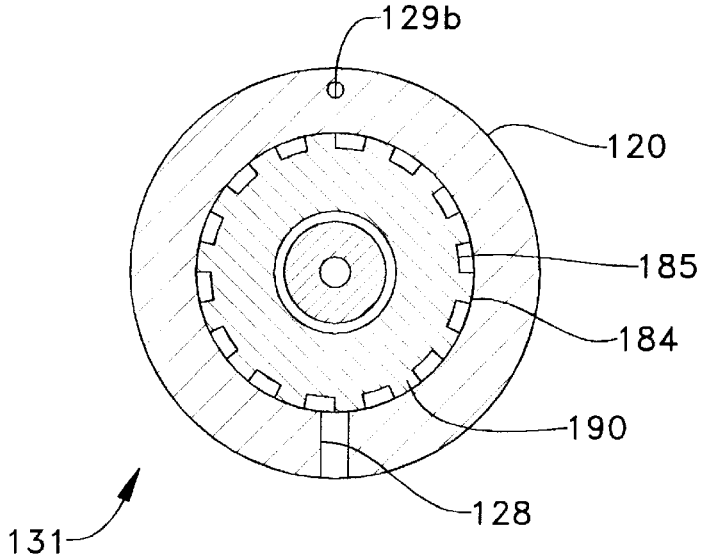
FIG. 7 is a sectioned view along section lines 7—7 of the control valve shown in FIG. 6.

Referring now to FIGS. 6 and 7, the alternative control valve 131 according to the present invention is illustrated. Like the previous embodiment, control valve 131 includes a pilot valve member 160 and an actuation valve member 190, both of which are spool valve members. Like the previous embodiment, a pilot balance chamber 170 is open on one side to a third actuation fluid drain 129*c* through a restricted escape passage 171. It is also open to high pressure actuation fluid inlet 130 via a branch passage 172 past a variable flow area seat 173, which is closed when the solenoid is de-energized and the respective valve members are in the positions shown. As in the previous embodiment, pilot valve member 160 moves to the right and achieves an equilibrium position that is dependent upon the flow area past variable flow area seat 173, which controls the fluid pressure in pilot balance chamber 170 acting on pilot hydraulic surface 165. When the solenoid is de-energized, pilot valve member 160 moves to the left to the position shown in which it closes annular seat 188 and opens seat 195. This reduces pressure in actuation balance chamber 192 causing actuation valve member 190 to move to the left against a back stop (not shown). In this position seats 185, 175 and 173 are closed.

As in the previous embodiment, actuation valve member 190 includes an opening hydraulic surface 193 positioned in opposition to a closing hydraulic surface 194. Opening hydraulic surface 193 is exposed to fluid pressure in a chamber 192 which is opened in one direction to high pressure actuation fluid inlet 130 through branch passage 182 and past annular seat 188, and in another direction to a low pressure drain past seat 195. Closing hydraulic surface 194 is exposed to fluid pressure in actuation balance chamber 180 which is open to the high pressure of actuation fluid inlet 130 via branch passage 182.

When actuation valve member 190 moves to the right, control seat 175 opens allowing high pressure actuation fluid to flow through branch passage 174 and into control passage 140 past an annulus in the actuation valve member. This movement of actuation valve member 190 simultaneously closes control passage 140 to a second low pressure actuation fluid drain 129*b*. Also when actuation valve member 190 moves to the right, actuation fluid cavity 128 is simultaneously closed to actuation fluid drain 129*b* and opened to high pressure branch passage 191 past a low flow seat 184. Low flow seat 184 is adjacent a plurality of spoked small flow area passages cut into the outer surface 181 of actuation valve member 190 (FIG. 7). As actuation valve member 190 moves farther to the right, a complete annulus is opened as high flow seat 185 opens to allow even more flow into actuation fluid cavity 128.

Actuation valve member 190 moves with pilot valve member 160 since movement of the pilot valve member opens annular seat 188, and reduces the flow area past seat 195, allowing pressure to rise in actuation balance chamber 192. This increases the hydraulic force on opening hydraulic surface 193, causing actuation valve member 190 to move to the right. As actuation valve member 190 moves to the right to follow pilot valve member 160, the opening past annular seat 188 is reduced to a point that a hydraulic balance is created between opening hydraulic surface 193 and closing hydraulic surface 194. Since the flow area past low flow seat 184 and high flow seat 185 to actuation fluid cavity 128 is made to be substantially proportional to the position of actuation valve member 190, the pressure in actuation fluid cavity 128 is substantially proportional to the amount of current supplied to the solenoid. Thus, although the specific structure of control valve 131 is different from that of control valve 31 discussed earlier, both valves utilize a pilot valve member and operate substantially similar through the use of hydraulic balancing in their respective actuation valve members 190 and 90.

INDUSTRIAL APPLICABILITY

The present invention finds potential application in any internal combustion engine in which it is desirable to closely control the injection rate trace of fuel to the combustion space within an engine. This is especially important in the case of diesel type engines because combustion efficiency and the presence of undesirable emissions and noise are closely related to the injection rate trace for a given engine operating condition. Since the present invention can provide an injection rate trace which closely matches the current rate trace to its solenoid, virtually any shaped injection rate trace can be achieved. This includes but is not limited to the square, ramp, boot and pilot injection rate shapes identified in FIGS. 1A–D. Since almost all engines operate at a wide variety of conditions, from idle to rated, it is highly desirable to have the ability to change the injection rate trace depending upon a particular operating condition. The present invention achieves this goal by the use of a hydraulically actuated fuel injector in which the hydraulic pressure acting on the internal intensifier piston is substantially proportional to the position of the control valve, which in turn is substantially proportional to the amount of current being supplied to the solenoid. Furthermore, the quick action of the pilot valve member to changes in solenoid current along with the quick action of the shuttle valve member allows each injection event to be ended abruptly using residual fuel pressure, which further improves the combustion characteristics.

It should be understood that the above description is intended for illustrative purposes and is not intended to limit the scope of the present invention in any way. For instance, those skilled in the art will realize that a wide variety of different control valve structures could provide the variable flow area that is proportional to solenoid current, but different in structure from the control valves illustrated. Furthermore, while the present invention has been illustrated with control valves that include a pilot valve member and an actuation valve member, those skilled in the art will appreciate that the function of the present invention could be accomplished using a single valve member. In any event, the scope of the present invention should be interpreted in terms of the claims as set forth below.

We claim:

1. A hydraulically actuated fuel injector comprising:

an injector body having a nozzle chamber that opens to a nozzle outlet;

a control valve mounted in said injector body;

a solenoid attached to said control valve and being moveable between a rest position and a fully energized position;

hydraulic means, within said injector body, for pressurizing fuel in said nozzle chamber to a fuel pressure that is substantially proportional to an amount of current being supplied to said solenoid;

a needle valve member positioned in said nozzle chamber and moveable between an open position in which said nozzle outlet is open and a closed position in which said nozzle outlet is blocked; and means for biasing said solenoid toward said rest position.

2. The hydraulically actuated fuel injector of claim 1 wherein said control valve includes a pilot valve member attached to said solenoid and an actuation valve member mounted in said injector body and moveable between a first position and a second position.

3. The hydraulically actuated fuel injector of claim 2 wherein said injector body includes an actuation fluid cavity that opens to an actuation fluid inlet, a first actuation fluid drain and a piston bore;

said hydraulic means includes a piston mounted in said injector body and moveable between an upper position and a lower position;

means for biasing said actuation valve member toward said first position when said solenoid is in said rest position; and said actuation valve member blocks said actuation fluid inlet and opens said first actuation fluid drain to said actuation fluid cavity when in said first position.

4. The hydraulically actuated fuel injector of claim 3 wherein said actuation valve member and said pilot valve member are spool valve members.

5. The hydraulically actuated fuel injector of claim 4 wherein said actuation valve member includes an opening hydraulic surface and a closing hydraulic surface positioned in opposition to one another; and one of either said opening hydraulic surface or said closing hydraulic surface being exposed to fluid pressure in said actuation fluid inlet.

6. The hydraulically actuated fuel injector of claim 5 wherein at least one of said injector body, said pilot valve member and said actuation valve member define an actuation balance chamber;

the other of said opening hydraulic surface or said closing hydraulic surface being exposed to fluid pressure in said actuation balance chamber; and at least one of said injector body, said pilot valve member and said actuation valve member defining a restricted supply passage extending between said actuation fluid inlet and said actuation balance chamber.

7. The hydraulically actuated fuel injector of claim 5 wherein at least one of said injector body, said pilot valve member and said actuation valve member define a pilot balance chamber;

said pilot valve member includes a pilot hydraulic surface exposed to fluid pressure in said pilot balance chamber;

at least one of said injector body, said pilot valve member and said actuation valve member defining a pilot balance passage with a variable flow area extending between said actuation fluid inlet and said pilot valve chamber; and means for changing said variable flow area in substantial proportion to said amount of current supplied to said solenoid.

8. The hydraulically actuated fuel injector of claim 5 wherein at least one of said injector body, said pilot valve member and said actuation valve member define a restricted drain passage extending between a second actuation fluid drain and an actuation balance chamber; and at least one of said injector body, said pilot valve member and said actuation valve member defining a restricted escape passage extending between a third actuation fluid drain and said pilot balance chamber.

9. The hydraulically actuated fuel injector of claim 8 wherein said restricted escape passage has a substantially fixed flow area.

10. The hydraulically actuated fuel injector of claim 2 wherein said needle valve member and said injector body define a needle control chamber;

said needle valve member includes a control hydraulic surface exposed to fluid pressure in said needle control chamber; and said needle control chamber being exposed to one of either a low pressure passage or a high pressure passage depending upon a position of said pilot valve member.

11. The hydraulically actuated fuel injector of claim 10 further comprising a shuttle valve member with a shuttle hydraulic surface mounted in said injector body and moveable between a go position and a stop position;

said needle control chamber being open to said low pressure passage when said shuttle valve member is in said go position, and open to said high pressure passage when said shuttle valve member is in said stop position.

12. A hydraulically actuated fuel injection system comprising:

a source of high pressure actuation fluid;

a low pressure actuation fluid reservoir;

a source of fuel fluid different from said actuation fluid;

a hydraulically actuated fuel injector comprising: an injector body that defines a fuel supply passage, an actuation fluid inlet, an actuation fluid drain and a nozzle chamber that opens to a nozzle outlet;

a solenoid actuated control valve attached to said injector body;

hydraulic means, within said injector body, for pressurizing fuel in said nozzle chamber to a fuel pressure that is substantially proportional to an amount of current being supplied to said solenoid actuated control valve;

a needle valve member positioned in said nozzle chamber and moveable between an open position in which said nozzle outlet is open and a closed position in which said nozzle outlet is blocked; and a first supply passage connecting said actuation fluid inlet to said source of high pressure actuation fluid;

a second supply passage connecting said fuel supply passage to said source of fuel fluid different from said actuation fluid;

a drain passage connecting said actuation fluid drain to said low pressure actuation fluid reservoir; and a computer in communication with and capable of controlling said solenoid.

13. The hydraulically actuated fuel injection system of claim 12 wherein said control valve includes a pilot valve member attached to said solenoid and an actuation valve member mounted in said injector body and moveable between a first position and a second position.

14. The hydraulically actuated fuel injection system of claim 13 wherein said actuation valve member includes an opening hydraulic surface and a closing hydraulic surface positioned in opposition to one another; and one of either said opening hydraulic surface or said closing hydraulic surface being exposed to fluid pressure in said actuation fluid inlet.

15. The hydraulically actuated fuel injection system of claim 14 wherein at least one of said injector body, said pilot valve member and said actuation valve member define an actuation balance chamber;

the other of said opening hydraulic surface or said closing hydraulic surface being exposed to fluid pressure in said actuation balance chamber; and at least one of said injector body, said pilot valve member and said actuation valve member defining a restricted supply passage extending between said actuation fluid inlet and said actuation balance chamber.

16. The hydraulically actuated fuel injection system of claim 14 wherein at least one of said injector body, said pilot valve member and said actuation valve member define a pilot balance chamber;

said pilot valve member includes a pilot hydraulic surface exposed to fluid pressure in said pilot balance chamber;

at least one of said injector body, said pilot valve member and said actuation valve member defining a pilot balance passage with a variable flow area extending between said actuation fluid inlet and said pilot valve chamber; and means for changing said variable flow area in substantial proportion to said amount of current supplied to said solenoid.

17. A hydraulically actuated fuel injection system comprising:

an injector body having an actuation fluid cavity that opens to an actuation fluid inlet, a first actuation fluid drain and a piston bore, and having a plunger bore that opens to a fuel supply passage and a nozzle chamber, and said nozzle chamber opens to a nozzle outlet;

a control valve mounted in said injector body and being movable between a first position that fully opens said actuation fluid inlet and closes said actuation fluid drain, and a second position that closes said actuation fluid inlet and opens said actuation fluid drain;

a solenoid attached to said control valve;

a piston positioned to reciprocate in said piston bore between an upper position and a lower position;

a plunger positioned to reciprocate in said plunger bore between an advanced position and a retracted position;

a portion of said plunger bore and said plunger defining a fuel pressurization chamber that opens to said nozzle chamber;

a needle valve member positioned to reciprocate in said nozzle chamber between a closed position that blocks said nozzle outlet and an open position that opens said nozzle outlet;

means, within said injector body, for biasing said needle valve member toward said closed position; and means for positioning said control valve at a partially open position between said first position and said second position in which said actuation fluid drain is closed and said actuation fluid inlet is less than fully open to said actuation fluid cavity.

18. The hydraulically actuated fuel injection system of claim 17 wherein said control valve includes a pilot valve member attached to said solenoid and an actuation valve member mounted in said injector body and moveable between said first position and said second position.

19. The hydraulically actuated fuel injection system of claim 18 wherein said actuation valve member includes an opening hydraulic surface and a closing hydraulic surface positioned in opposition to one another;

one of either said opening hydraulic surface or said closing hydraulic surface being exposed to fluid pressure in said actuation fluid inlet;

at least one of said injector body, said pilot valve member and said actuation valve member define an actuation balance chamber;

the other of said opening hydraulic surface or said closing hydraulic surface being exposed to fluid pressure in said actuation balance chamber; and at least one of injector body, said pilot valve member and said actuation valve member defining a restricted supply passage extending between said actuation fluid inlet and said actuation balance chamber.

20. The hydraulically actuated fuel injection system of claim 19 wherein at least one of said injector body, said pilot valve member and said actuation valve member define a restricted drain passage extending between a second actuation fluid drain and said pilot balance chamber.

* * * * *